United States Patent [19]

Harrison

[11] 4,204,468

[45] May 27, 1980

[54] EMBOSSING PRESS

[75] Inventor: Paul H. Harrison, Santa Barbara, Calif.

[73] Assignee: M & R Seal Press Co., Inc., Roselle, N.J.

[21] Appl. No.: 926,340

[22] Filed: Jul. 20, 1978

Related U.S. Application Data

[63] Continuation of Ser. No. 747,056, Dec. 3, 1976, abandoned, which is a continuation of Ser. No. 524,324, Nov. 15, 1974, abandoned.

[51] Int. Cl.[2] ..... A44B 5/00

[52] U.S. Cl. ..... 101/3 SP

[58] Field of Search ..... 101/3 R, 3 SP, 316, 101/407 BP

[56] References Cited

U.S. PATENT DOCUMENTS

| | | | |
|---|---|---|---|
| 1,365,401 | 1/1921 | Hellberg | 101/3 SP |
| 1,658,823 | 2/1928 | Willard | 101/3 SP |
| 2,005,340 | 6/1935 | Jaffin et al. | 101/3 SP |
| 2,203,644 | 6/1940 | Priesmeyer | 101/3 SP |
| 2,706,447 | 4/1955 | Priesmeyer | 101/3 SP |
| 2,906,197 | 9/1959 | Priesmeyer | 101/3 SP |
| 2,937,590 | 5/1960 | Priesmeyer | 101/3 SP |
| 2,939,385 | 6/1960 | Wolberg | 101/3 SP |
| 3,260,192 | 7/1966 | Ostenberg | 101/3 SP |
| 3,587,454 | 6/1971 | Meyer | 101/3 SP |

*Primary Examiner*—Edward M. Coven
*Attorney, Agent, or Firm*—A. A. Orlinger

[57] ABSTRACT

An embossing press designed to enable embossing, for example, a sender's name and address in customary reading location respectively separately selectively on letter writing paper sheets and on envelop flaps is provided with unique die plate carrying means enabling easy removal of the opposed die holders each with its individual die plate and replacement of them in horizontally reversed position. Each of the die plates is mounted in the terminal slot in its respective spring leaf or arm of a double-armed spring die holders carrier, both arms of which are joined at their inner end integrally to a yoke, by means of which the spring die holders carrier is attached rigidly firmly yet removably (when needed) to the supporting base of the press.

23 Claims, 12 Drawing Figures

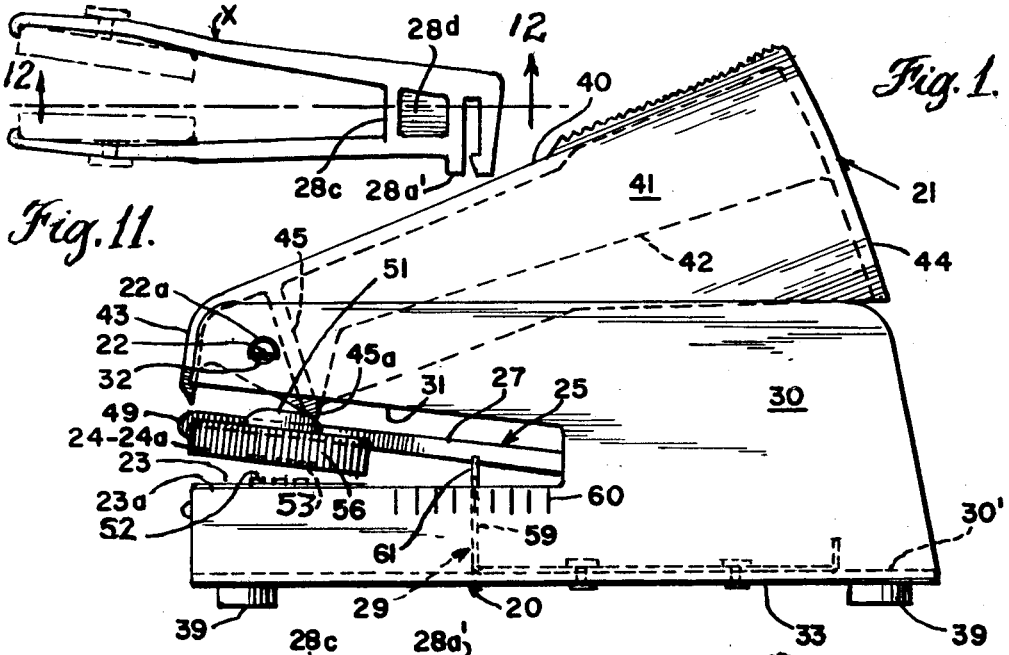
Fig. 1.
Fig. 11.
28d
12
12
40
28c
28a'
41
21
45
51
42
44
22a
43
22
45a
32
31
27
25
30
49
24-24a
23
23a
53
56
60
52
61
59
30'
29
20
39
33
39
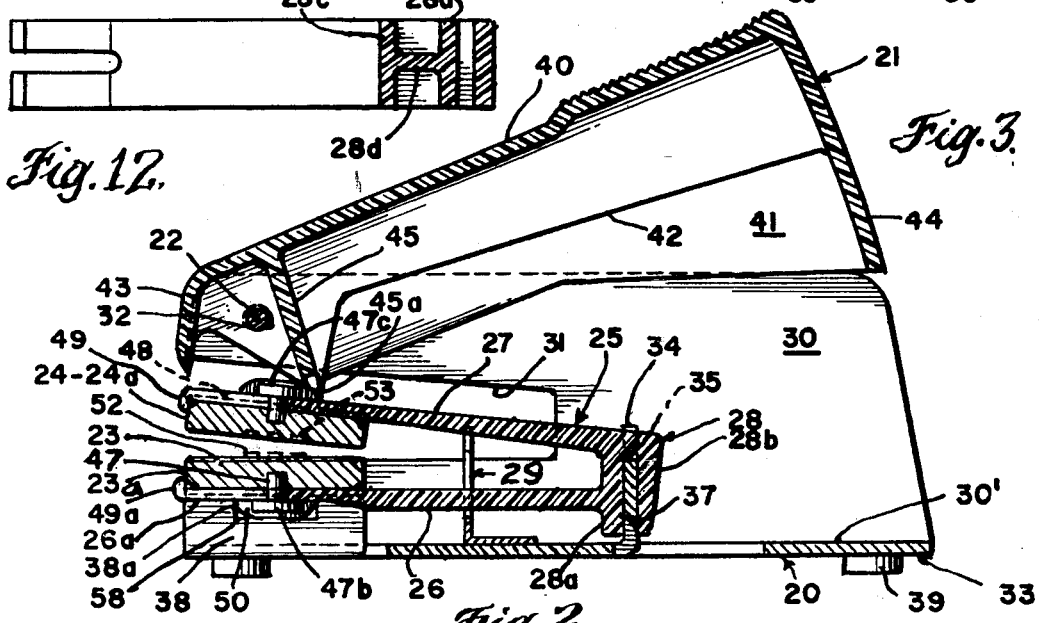
28c
28a'
40
21
Fig. 3.
Fig. 12.
28d
41
44
22
45
42
43
45a
32
47c
49
48
27
31
25
34
30
24-24a
53
35
52
28
28b
23
47
29
23a
37
30'
49a
26a
38a
58
38
50
47b
26
28a
20
39
33
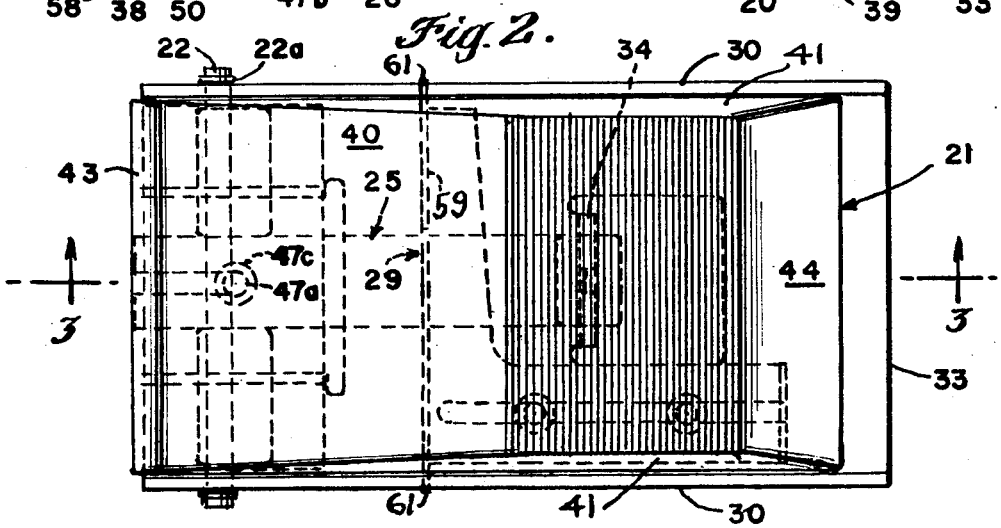
Fig. 2.
22
22a
61
34
30
41
40
21
43
25
59
47c
29
44
47a
3
3
33
61
41
30

Fig. 4.
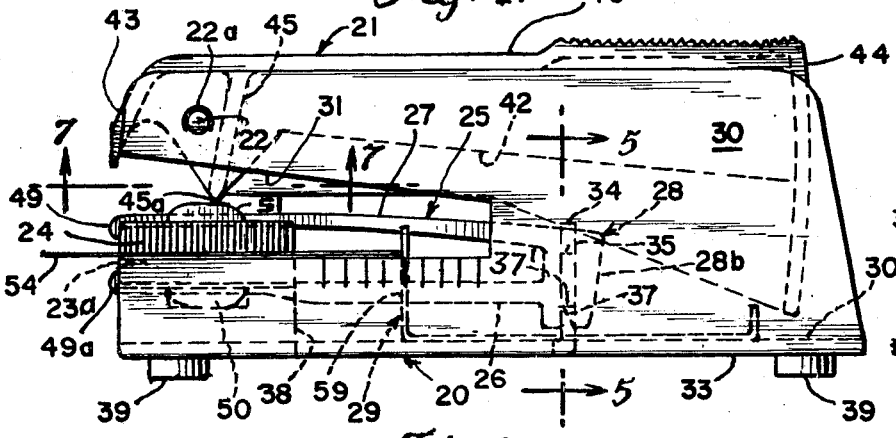
Fig. 5.
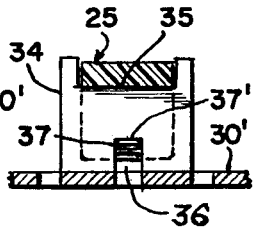
Fig. 6
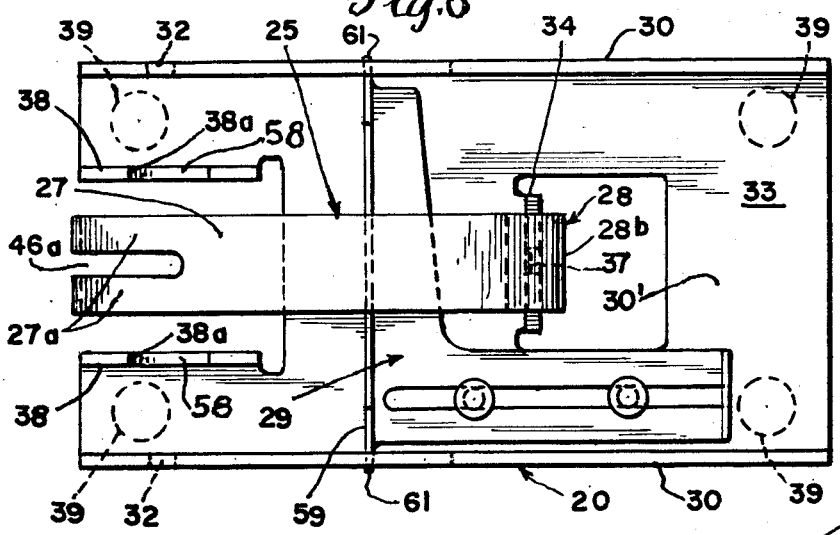
Fig. 7.
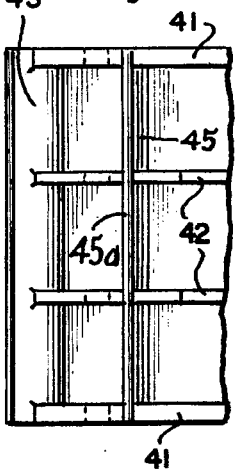
Fig. 8.
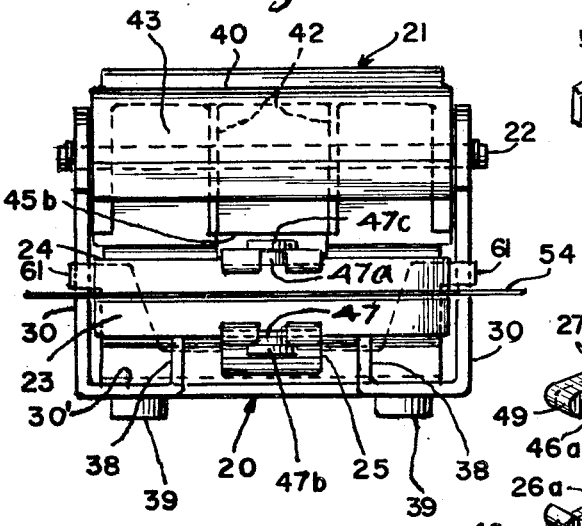
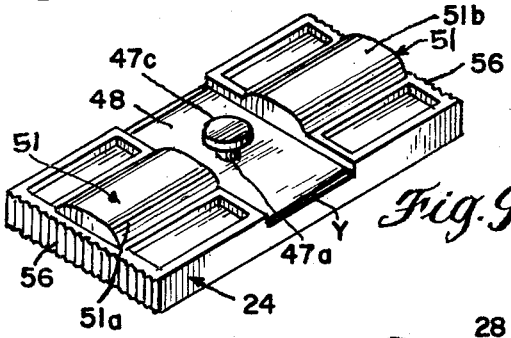
Fig. 9.
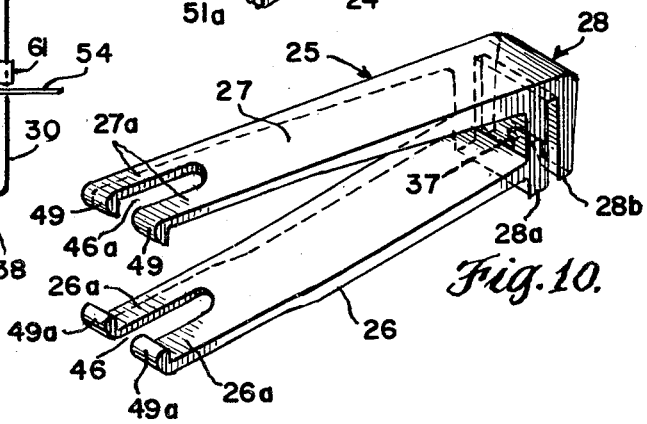
Fig. 10.

EMBOSSING PRESS

This is a continuation of application Ser. No. 747,056 filed Dec. 3, 1976, now abandoned, which was a continuation of the then pending (now abandoned) application Ser. No. 524,324 filed Nov. 15, 1974.

FIELD OF INVENTION

This invention is that of a hand operated embossing press of the type used for embossing personalized information, such as monograms and/or names and addresses, on sheets of writing paper and the flaps of envelopes such as mailing envelopes. Such presses include a body frame, an embossing die-supporting spring member, vertically opposed cooperating embossing die plates, the male one of which has the desired indicia in raised characters on its embossing face and the female die plate has the corresponding indicia recessed on its opposing embossing face.

The die plates normally are held apart to enable inserting therebetween the material (e.g. writing paper or envelope) to be embossed, and pressure is applied by depressing by hand a pivoted handle that imparts relative movement of the die plates into mating registry and while depressing the respective portions of the inserted paper into the recesses of the female die, thereby impressing the indicia of the matrix unto the paper.

When the die plates are positioned in the press to emboss a design or indicia onto a sheet of paper to be read with the paper held in upright position, then application of the dies to the flap of an envelope will provide such design or indicia upside down when the flap is folded over in its envelope sealing position. To avoid such undesirable embossing of the flap, means need to be provided to enable reversing the position of the die plates to allow the press to be used selectively for embossing sheets of paper as well as the flaps of envelopes with the embossing in proper reading position on the flap.

SUMMARY OF THE INVENTION

The present invention provides an embossing press with unique structural means that allow easy removal of its die plates to enable rotating each of them horizontally about an axis normal to the face of the plate and thus to be replaced in reversed position.

The press of the invention is composed of relatively simple parts, easily and economically assembled, and of such materials that provide a sturdy lasting device that can be used readily in the home or office without requiring any degree of skill in operating it as well as in the reversal of the die plates.

This ready removability of the die plates is provided by slidably removably mounting each of them between a separate pair of fingers that are the sides of an outer-end-open slot of a respective arm or leaf of the die-plate-carrier spring, which fingers are provided with means for restraining the plates against displacement during embossing, but yet yielding to moderate pressure (applied by the user's fingers) to release said dies when they have to be removed.

The invention will be understood and other advantages of it recognized from the following detailed description of a presently preferred embodiment, when read in relation to the accompanying drawings, wherein:

FIG. 1 is a side elevational view of the assembled embossing press with its operating lever shown in normally raised position when the press is not in use;

FIG. 2 is a top plan view of FIG. 1;

FIG. 3 is a cross section taken along the line 3—3 of FIG. 2;

FIG. 4 is a side elevational view similar to FIG. 1, but with the operating lever shown in lowered or embossing position;

FIG. 5 is a fragmentary cross section taken on line 5—5 of FIG. 4;

FIG. 6 is a plan view of the base member of the press;

FIG. 7 is a fragmentary bottom view (taken as indicated by the arrows on line 7—7 of FIG. 4) of the pressure end of the pressure lever;

FIG. 8 is a front end view of FIG. 4 (as viewed from its left);

FIG. 9 is an isometric view of one of the die or embossing plates, particularly the upper one;

FIG. 10 is an isometric view of one embodiment of the spring member for removably carrying the die plates;

FIG. 11 is a side elevational view of another embodiment of the spring member; and FIG. 12 is a cross section taken along the line 12—12 of FIG. 11.

DETAILED DESCRIPTION

Referring now more particularly to FIGS. 1 and 4, the embossing press of this invention comprises;

a base member 20 (adapted to rest, for example, on a table or desk) preferably formed of sheet metal of sufficient gage to provide a rigid and sturdy supporting structure;

a hand-operated pressure lever 21 (i) pivotally mounted at the front (i.e. die-located) end of base member 20 by means of a transversely extending pivot pin 22 (beneficially removably locked in place by engaging C-lock **22*a*** in a peripheral groove adjacent one end of it), (ii) and in both width and length substantially coinciding with those of the base member, thereby in effect, constituting a combined inverted open box-shaped operating lever and upper cover or lid of or for the press;

a pair of opposed embossing die plate holders so adapted or constructed (a) for one holder to be fixedly held in position at the front or embossing end of the press and the other of them to be (i) firmly held but selectively movable to substantially contacting embossing engagement with the first holder and then (ii) released to return to its starting position; and (b) for each holder to have rigidly attached to it or intergral therewith, its respective one of a pair of mated embossing die plates 23 and 24.

One embodiment of a carrier or support for the embossing die plate holders shown in the drawings is the relatively horizontally disposed substantially V-shaped (or narrow U-shaped) spring member 25 with its slightly diverging (as extending to the front end of the press) arms 26, 27, each being bifurcated at its free end to receive in slidable snug relation the mounting stud affixed to its respective one of the die plate holders. As more clearly shown in FIG. 3, the lower arm 26 of spring member 25 supports embossing plate holder **23*a* (operation-wise designated the stationary die-plate holder) while the opposed upper arm 27 of spring 25 supports the upper or depressable die plate holder 24*a***.

As illustrated, male die plate 23 has raised characters or insignia formed on its working face and female die plate 24 has opposed and corresponding mating depressions or recesses. These positions may be reversed, if desired, to make the upper embossing die the male with raised insignia (on its working face) to mate with recesses or depressions provided in the lower (and thus female) die plate.

The use of the embossing press is enhanced by its including the insertion distance gage or stop 29 selectively adjustably mounted on base 20, to limit the extent of insertion of a sheet of paper or other material to be embossed.

The arms 26, 27 of spring member 25, at their inner ends (i.e. the vertex or base of spring 25), advantageously are joined integrally (as an overall unitary spring member) to a rear portion or anchoring yoke 28 (of spring 25) which beneficially is thicker than are arms 26, 27 (at that end) and bifurcated to provide two parallel horizontally spaced apart depending legs **28*a* and 28*b* that straddle the (bottom-opened and sides-opened) slit in yoke 28 to serve as means rigidly (but removably if needed) to support spring 25 from base 20** (as later described more specifically).

As seen better in FIGS. 1 and 3, base 20 is in elongated open-ended (U-shaped) channel form, having extending longitudinally over the forward portion of each of its side walls 30 a horizontal slot 31 open at the front end. On each wall 30 above the forward end of slot 31 in the walls 30 there also is provided a hole 32 through both of which pivot pin 22 transversely is inserted, and on which pin operating lever 21 pivotally is mounted.

Yoke 28 of spring member 25 is mounted fixedly but removably on tongue 34 (FIGS. 3 to 6) provided intermediate the ends of the floor 30' of base member 20 and centrally between side walls 30. Advantageously tongue 34 is integral with floor 30' by having been cut out along its two opposed sides and upper end from, and turned upwardly perpendicular to, floor 30'. Adjacent the bottom of tongue 34 there is provided in it a small rectangular opening 36 initially die punched out before tongue 34 was turned upright, seen in FIG. 6.

As best seen in FIGS. 3 and 5, tongue 34 is provided at its upper end with a shallow notch 35 to serve to center and to seat spring member 25. Rear leg **28*b* of yoke 28 is formed with an inwardly extending catch 37 that protrudes snugly into opening 36 in tongue 34 and interlocks therewith thereby rigidly removably anchoring spring member 25 to prevent its upward displacement, because (in FIG. 4) the underside of the top rim of opening 36 resistingly contacts the top of catch 37. However, if it is desired to disengage yoke 28, its rear leg 28*b* can be pulled or forced backward, away from contact with tongue 34, sufficiently to enable catch 37 to pass the top rim of opening 36 as yoke 28** is raised.

At its front end a middle portion of the floor of base member 20 is cut away and two opposite portions of its adjacent the resulting opening are severed at the rear end of each of them from the floor of base 20 and turned up normal to it to provide a pair of parallel spaced apart inner upright rests 38 (for the stationary die as further below shown) parallel to and respectively spaced inwardly from walls 30, thus forming a pair of parallel longitudinally extending narrow U-shaped channels, as best seen in FIGS. 6 and 8.

Desirably, a leg button 39 (formed of rubber, resilient plastic, felt or other suitable material) is provided under each corner of base member 20 to avoid marring the desk or other surface on which the press is used.

Pressure lever 21 is a unitary structure (beneficially of suitable plastic and molded in one piece) having a top wall 40 and depending from it opposed side walls 41. The side walls extend in close proximity to but amply clear the inner surfaces of walls 30 of base member 20. Longitudinal ribs 42 depend from the under surface of top wall 40 and intermediate of side walls 41 of pressure lever 21, to reinforce it. Pressure lever 21 also includes a front wall 43 and a rear wall 44.

Spaced shortly inward of front wall 43 of lever 21, and depending from the under surface of its top wall 40, is a transverse die-depresser rib 45. the free bottom edge **45*a* of which beneficially is rounded, for reasons seen below. Forwardly of rib 45, each of side walls 41 is provided with an aperture or hole coincident with holes 32 in side walls 30 of base member 20. Pivot pin 22 on being passed through pivot holes 32 and the corresponding holes in pressure lever 21, secures the latter to base member 20 for pivoted movement of lever 21 on pin 22**.

Each of the arms 26, 27 of spring member 25 (see FIGS. 6 and 10) has at its free end its respective short longitudinal slot 46 (or **46*a*) (open at the free end). Each of these slots thus provides its respective pair of opposed parallel fingers 26*a* (on arm 26) and 27*a* (on arm 27), between which snugly to receive and fixedly yet removably hold the short shank 47 (or 47*a*) of its respective one of the die plate holder mounting studs having a respective head 47*b* (or 47*c*) (FIGS. 3 and 9) of greater diameter than the width of the slot. A separate one of these shanks 47 (and 47*a*) integrally is affixed to its respective one of die plate holders 23*a*, 24*a* centrally in its respective recessed area 48**.

The diameter of the shank of each of these studs is so close to the width of the slot to allow each stud to be easily slidable into and out of its respective slot 46, or **46*a*, but without motion transverse to the slot particularly when the die plate holder is in place for the embossing operation. Thus, stationary die plate holder 23*a* is removably slidably held by spring fingers 26*a* and the depressable or upper die plate holder 24*a* similarly is held by spring fingers 27*a***.

The width of the recessed area 48 of each die plate holder **23*a*, 24*a* equals the overall width of both of its spring fingers 26*a* or 27*a* (including the slot between them) that are to be received in recessed area 48 when the shank of a stud 47 (or 47*a*) is slid into its respective slot 46 (or 46*a*) (FIGS. 3 and 8**). This enhances precision of the mating of the dies in the embossing operation.

The forward free end of each of the spring fingers **26*a* and 27*a* terminates in its respective die holder-restrainer or stay 49 or 49*a* normal to its corresponding finger 26*a* or 27*a* and overlapping the front wall surface of the respective die plate holder 23*a* or 24*a* for a short distance sufficient to maintain the holder firmly secured in its required working position and restrained against slipping off of the fingers that support it. In that secured position within the respective slot 46 or 46*a* the rear surface of the shank 47 (or 47*a*) of stud 47–47*b* (or 47*a*–47*c***) thus is pressed snugly against the inner terminal wall of the slot.

The length of the slot 46 (or **46*a*) is such that the rear arcuate surface of the shank of the stud directly contacts the rear upright arcuate surface of the slot when the rearwardly facing vertical surfaces of the die holder restrainers 49 (or 49*a***) are in direct contact with the outwardly facing longer vertical surface of the die holder. That then restrains the die holder against any forward and aft movement during the embossing and so also enhances precision of the mating of the dies.

Depending die holder-depressing rib 45 is recessed intermediate its ends in its portion 45*b* (for example, in the location substantially between the reenforcing ribs 42) so as to clear the top of stud head 47*c* on die plate holder 24*a* when operating lever 21 is depressed.

Each of fingers 26*a* and 27*a* is sufficiently springy or resilient to restrain its respective die plate holder 23*a* and 24*a* as just earlier above described, but yet to give away outwardly from contact with the respective holder, when the user takes hold of the latter to withdraw it from the press to reverse the position of the holder as explained further below.

Release of the individual die plate holder is enhanced in a modified form of spring having two bends in the forward portion of the arms 26 and 27 as shown in FIGS. 10 and 11. For example, at a location X removed from the inner vertical surface of the die plate holder restrainers a distance about equal to the front to rear width of the die plate holder, the forward end of the arm is bent outwardly at an angle of up to about 3°. Then at a second location removed inwardly from the inner vertical surface of the restrainers and intersecting the axis of the stud on the die holder, the forward part of the arm is bent inwardly to a distance to form an angle of up to about 3° from the base line of the angle of the first bend.

Then for the fingers (extending from the outer one of the two bends) suitably firmly to carry the die plate holder, the shank of its stud is made that small amount longer than the thickness of the fingers at the inner end of the slot to allow the underside of the head of the stud firmly to be pressed against the outer surface of the fingers and to leave exposed a small part of stud length between the under surface of the fingers and the flat surface of the recessed area on the back of the die plate holder.

These two bends not only serve well in retaining the die plate holder firmly during the embossing step, but also contribute to the easy release of the die plate holder from the restrainers because of the flexing of the fingers at the outer one of the bends, located about in the plane of the axis of the shank of the stud, during the removal of the die plate holder.

Release of the die plate holders by the restrainers also is enhanced by the inclusion along each of the outer end edges of recess 48 (on each of the die plate holders) of a chamfer Y to an extent along its longitudinal vertical wall suitably less than the height of the vertical inner surface of the individual restrainer.

A raised portion 51 extends laterally outwardly from each side of the outer (or non-embossing) surface of the recessed portion 48 of embossing plate holder 24*a* to approximately the respective outer edge of the plate holder. The upper surface of each such raised portion 51 is oblate or substantially flat at its polar location and smoothly blends into curved terminal faces 51*a* at its forward and rearward areas, thereby providing a pair of longitudinally spaced apart identical cam surfaces. The rounded bottom edge 45*a* of transverse rib 45 is adapted to ride up onto these cam surfaces when the operating end of lever 21 is depressed to produce an embossing. These cams thus reduce the distance which lever 21 must travel to provide embossing with consequent lower height of the embosser when not in use.

The lower or stationary embossing die plate holder 23*a* similarly has a pair of raised portions 50 corresponding to raised portions 51 of the upper plate holder 24*a*. That enables interchanging the plate holders if needed.

Each of the spaced apart parallel upright rests 38 in base member 20 has a cut out portion 58 (FIG. 6) of suitable shape to enable both together to serve as cradles or seats for the spaced apart raised portions 50 when lower die plate holder 23*a* is slid into operating position on arm 26. Advantageously, the cam portions, e.g. die plate holder 23*a* and the upper edges of the rests 38 are so sized and located that when holder 23*a* sets on rest 38 the forward end of each cam portion 50 touches the rear corner 38*a* of the forward part of the upper edge of the rests 38. Thereby, in the embossing the mating die blocks are further restrained against forward motion under the embossing pressure.

Spring member 25 may be made of any of the spring steels used in the seal press art as a unit for integrally carrying embossing die holders. It is advantageous to mold spring member 25 as seen, e.g. in FIG. 10, as a one piece plastic unit (composed, for example, as more fully described later below). In some embodiments of the press of the invention a firmer rebound of spring arm 27 can be provided in a plastic unit, if desired, by using a modified construction as shown in FIGS. 11 and 12 which also enhances maintaining the alignment between the two pairs of fingers 26*a* and 27*a*.

In such other form the leg 28*a* of anchoring yoke 28 can be increased in width as one solid piece up to about four times its width as seen in FIGS. 2 and 10. Alternatively, such increase in width can be provided by forming leg 28*a* as H-shape in horizontal cross section (as shown in FIG. 12) with an added shorter leg 28*c* forwardly spaced away from the leg 28*a'* and with both of them integrally joined together with a transverse-leg 28*d*.

OPERATION OF THE PRESS

With the assembled embossing press having its parts in their idle position as shown in FIGS. 1 and 3, a sheet of personal or other stationary or other paper 54 (FIG. 4) to be embossed is slid into the open jaws between embossing plates 23 and 24 until the sheet's leading edge contacts upright 59 of gage member 29. For convenience, mill markings 60 are provided on the outside of either or both side walls 30 of base 20 along slot 31 in each wall. Ears 61 extending outwardly from both sides of upright 59 and visible at slots 31 FIGS. 4, 6 and serve as an indication, e.g. along the markings 60, to facilitate adjusting gage 29 for the desired spacing of the embossing from the top edge of the sheet.

Applying pressure (as by the heel of the hand) against the rear portion of lever 21 depresses it and causes the rounded tip 45*a* of rib 45 to ride up over the cam surface provided by the curved approach face of portion 51 and onto its upper more planar surface (as shown in FIG. 4), thereby pressing upper embossing die plate 24 forcibly down upon the inserted sheet and against the raised insignia markings 52 on die plate 23 thereby providing an impression of the insignia embossed in the sheet.

Release of the applied pressure permits rebound of spring arm 27 to return operating lever 21 from its FIG. 4 position to its idle FIG. 1 position, because spring 25 is constructed to maintain plate holders 23*a* and 24*a* spaced apart out of gripping engagement when the press is not in use.

The shape of these cam surfaces on raised portions 51 is such that rib 45 smoothly moves upper die plate holder 24 toward stationary die plate 23 as lever 21 is depressed. Then as the free bottom edge 45a of rib 45 rides onto the substantially flatter portion 51b, (i) uniform pressure is applied from the rear to the front (over the width) of the die plate holder, and (ii) then also the full length of the cam surface engaged by the free bottom edge of rib 45 applies pressure uniformly from side to side over the entire lengthwise area of the embossing plate. Thereby the embossed indicia provided in the sheet is overall uniformly clear cut and unmarred.

The unique construction for easily mounting the embossing die plate holders and for enabling their facile removal and reversal is an important feature of this invention. That feature is particularly significant in embossing devices to be used alternately for embossing writing paper and flaps of mailing envelopes with the same indicia.

It can be recognized that if the embossing plates are mounted so that a sheet of paper embossed thereby bears the embossed design or indicia in upright position at the top of the sheet, then embossing the flap of an envelope with the die plates in the same position results in the design or indicia being upside down when the envelope flap is folded over to its normal sealing position. Removing the embossing plates from the press and rotating them horizontally through 180 degrees and then returning them to their respective positions in the press, enables embossing the flap of an envelope so that the embossed indicia will be upright when the flap is folded over to sealing position.

REVERSING THE EMBOSSING PLATE HOLDERS

The sides of upper embossing die plate holder 24 accessible through slots 31 are provided with knurling 56 to present a friction surface whereon to enhance grasping that plate between a finger and the thumb. Thus grasped, upper die plate holder 24a readily can be unseated from its firmly fixedly held position on fingers 27a and be withdrawn from the press past restrainers 49 of spring arm 27, which then are flexed upwardly and out of their restraining position sprung over the forward edge of the thus being removed die plate holder.

The die plate holder thus removed is rotated horizontally through 180 degrees and thus replaced into fixed holding engagement by spring fingers 27a. The restrainers 49 then snap back into restraining position over its trailing edge as die plate holder 24a is reseated securely in its operative position.

To reverse lower die plate holder 23a because the corresponding knurling 57 on lower die plate holder 23a is not readily accessible (in the illustrated embodiment) while that plate is in its seated position, it is better to turn the press bottom side up. The bottom stud 47, however, is accessible through the front opening (between the rests 38) in the floor of base member 20.

Then, merely by finger pressure forwardly against the rear of the head of stud 47 (which may be of increased height), plate holder 23a can be pushed forward past its restraining stays 49, springing fingers 26a as stays 49 ride over the leading edge of the plate holder in its withdrawal which then can be completed. Alternatively, after a portion of knurling 57 is exposed beyond the forward end of the press after the holder's partial withdrawal by the finger pressure, the knurling now may be grasped by thumb and forefinger for complete removal of the die plate holder from the press.

Die plate holder 23a then likewise is rotated horizontally through 180 degrees and is replaced by inserting the shank of its stud 47 into slot 46 and pushing the plate holder back until the stays 49a snap down over its trailing edge and plate holder 23a thus again is seated in operating position.

To assure that the embossing die plates are aligned in correct mating registry position of the insignia on them, the forward exposed edges of the die plate holders are provided with suitable identifying markings, visible from outside the press, to indicate whether both die plates are in position for embossing sheets of paper or in reverse position for embossing flaps of envelopes.

For example, a different selected color can be applied in a suitable location on the normally front and rear faces of the die plate holders, whereby one exposed color designates the sheet embossing position and the other color, when exposed, indicates that the plates then are in their reversed position for embossing envelope flaps.

The individual elements of the embossing press of this invention can be produced from any metal or other material for construction suitable to the performance of the respective function of individual element and its practical performance life expectancy. In that respect, it is economically advantageous to produce lever member 21, which, as earlier herein indicated, also serves as an upper cover or lid for the press, as a monolithic molding of a light weight rigid thermoplastic resin. That can be taken from those resins employed for injection molding of machine parts and referred to in the trade as engineering plastics because of their excellent mechanical properties. Among such resins the so called acetal copolymers (produced by copolymerization of trioxane with ethylene oxide) have been found particularly desirable for producing lever 21 with its integral different ribs, by injection molding. One brand of such resin commercially available is that designated CELCON M-90 (product of Celanese Corporation, New York, N.Y.). These acetal copolymers have a low coefficient of friction, so that when formed of such acetal copolymer the rounded bottom edge 45a of rib 45 has lasting wear properties despite its repeated rubbing over the cam surfaces 51.

As stated earlier above (page 10 lines 26 to 28), spring member 25 can be molded as a one piece plastic unit. Such unit can be molded of the same general type of resin as that of the pressure lever 21, e.g., acetal copolymer. It is beneficial, however, to utilize such resin reinforced with fiber glass, and even in pre-stressed condition. Thereby the spring fingers 26a and 27a are sufficiently rigid to maintain the normal spacing provided by the respective slot 46 or 46a between them and are sufficiently resilient to return to normal position on repeated flexing without undergoing fatigue after long periods of use.

In the molded plastic spring member 25 to assure having the needed flexibility in the outer end of the fingers 26a and 27a readily to allow the required release of the die plate holders from the stays 49 and 49a when the holders are to be withdrawn, it is desirable (as shown in the embodiment in FIG. 10) that the fingers or at least the forward portion of them be somewhat thinner than the rest of arms 26 and 27, but yet sufficiently thick to have adequate firmness rigidly to maintain the die plate holders for use.

So far as presently observed, the needed accurate registry of the raised insignia markings 52 on male die plate 23 with the corresponding depressions in female die plate 24 regularly repeatedly dependably is provided by having both arms 26 and 27 of spring 25 serve as supports for the die plate holders. However, since die plate holder 23*a* is stationary and thus so also is spring arm 26, (i) that part of the latter rearward of die plate holder 23*a* and forward of leg 28*a* of yoke 28 may be omitted and (ii) the remaining part of arm 26 that joins its fingers 49*a* can be molded integral with a like acetal copolymer rigid thermoplastic resin in a rigid rectangular form to bridge and be firmly affixed to the upright rests 38 and having midway of its forward part an open-ended slot under and about as long as slot 46 and, if need be, just enough wider than the diameter of stud 47 to enable it to pass to the inner end of the slot in that bridging part. That modification can receive and hold die plate holder 23 rigidly fixed as it is held in the embodiment having the complete arm 26.

While the description above refers to the die plate and the die plate holder as separate elements joined together as a unit, it is advantageous to cast the female die plate and its holder jointly as a single zinc die casting which may be designated the female die-holder 24–24*a*. It is preferable, however, to make the male die plate as a set plastic resin, for example, by injection molding polystyrene (which may be high impact) against the female zinc die casting die plate. That polystyrene male die plate then is permanently affixed by double adhesive faced tape to its die plate holder which can be a rectangular steel block.

While the invention has been explained by describing use of a single set of reversible die plates and holders, it is understood that the embossing press of the invention is equally applicable to permit optional use of different sets of die plates and holders in the same press, e.g. for different members of the same family.

According to the second immediately preceding paragraph, while the female die plate is said to be a zinc casting, instead it can be the working face of merely a rectangular steel block. In either case, the lettering and any symbol or other insignia are sunk into the working face of the female die in known manner instead of affixing a die plate bearing them. Thus, the term "die-holder" is used in the generic sense to cover both (i) the combination of a die plate such as a male die plate either cast or molded in plastic affixed to a die plate holder and (ii) the unitary solid die block constituted of merely a zinc die casting or a rectangular steel block with the lettering and other indicia worked directly into its surface thus omitting a separately affixed die plate.

The underside of the die-holder, which carries no lettering or other indicia, also can be called its non-embossing or non-working face.

So far as presently indicated the earlier above fully described unitary plastic spring is preferred over the indicated possible subsituted steel spring. Some additional points may be noted about the plastic spring. For example, the plastic spring arm such as spring arm 27 can be about 3 inches long from the anchoring tongue 34 to the outer end of restraining stubs 49. The stubs can extend to 0.02 inch from the underside of the spring fingers which latter can (i) be 0.08 inch thick and taper to 0.07 inch thickness where meeting the stubs and (ii) extend about 0.77 inch from the innermost point in the slot to the outer end of stubs 49. The innermost bend in the spring arm can be at 1.2 inches removed from the inner wall of the stubs 49.

Obviously, the height of chamfer Y is less than that of the inner wall of the restraining stubs 49 and as so far as presently indicated should not exceed 0.01 inch.

The embossing press of the invention has been described in detail by reference to its being used to emboss personal information such as monograms and/or names and addresses on sheets of writing paper and flaps of envelopes such as mailing envelopes. It is understood that this embossing press can be used to emboss any other information or symbols or other indicia on any other paper or sheet material that can be embossed and retain the resulting embossment. Such material thus can be described broadly as "embossable sheet material," and what can be embossed on it broadly can be called "information and/or symbols."

The embossing press of the invention also has been described primarily in relation to its use in embossing names and addresses on letter writing paper and, after turning its die plates 180 degrees in a horizontal plane, on the flaps of envelopes for such embossed paper. However, certain of its novel and unobvious features also are applicable for the press to be used for other embossable sheet material embossing purposes. Thus, reference in the claims to the embossing press of this invention need not be limited to its use solely on correspondence paper and flaps of envelopes for such paper.

What is claimed is:

1. An embossing press for use on embossable sheet material and having an embossing or forward end, comprising (a) a unitary base frame having as integral parts thereof (i) a floor having integral front and rear portions, said front portion including (b) means for supporting a die-holder thereon at said embossing end and, (ii) upwardly extending from said floor at a position rearward of said embossing end and thence forwardly to a position over said embossing end a lever-supporting portion, provided with means for pivotally supporting thereon the anchoring end of an operating lever;

(c) an operating lever having an anchoring end and being pivotally supported at said end, (d) a lower die-holder having a support back supported thereon and in stationary position on said die-holder supporting means therefor, (e) a spring arm having a free end near said forward end and a fixed end, said spring arm (i) serving to support at its free end an upper die-holder also having a support back and spaced above said lower die-holder and in a position to enable said upper die-holder to be moved with that free end toward and away from said lower die-holder, whereby by such movement of the upper die-holder toward said lower die-holder their respective opposed faces are brought into mating registry during embossing operation, and (ii) having anchoring means as an unitarily integral part thereof at the fixed end;

(f) said frame floor having as a unitarily integral part thereof and extending directly upwardly therefrom a spring arm-anchoring means holding part, to which holding part there is fixedly yet removably anchored said spring arm-anchoring means;

(g) said spring-arm anchoring means being so designed as to friction-fittingly fixedly yet removably anchor the spring arm to said anchoring means holding part; and (h) said operating lever having a pressure-transmitting member depending therefrom at said embossing end and rearward of said pivotal support means, said member being so positioned to be brought into pressure-transmitting contact with the top surface of said upper die-holder, whereby manual downward force applied to the top surface of said operating lever at a locus behind said member will cause said lever to pivot on said pivotal support means impelling said upper die-holder to move downwardly toward said lower die-holder thereby effecting mating engagement between their opposed faces for embossing sheet material placed between said faces; said spring arm being flat and bifurcated at its free end and thus being provided with adjacent spaced apart spring fingers bounding an open-ended longitudinal slot as means for supporting said upper die-holder, said upper die-holder having on its top securing means enabling the die-holder to be fixedly but removably engaged by the bifurcated end of the spring arm.

2. An embossing press as claimed in claim 1, wherein said spring arm-anchoring means holding part integral with the floor of said base frame is located remote from said embossing end of the press, and the means for supporting said lower die-holder in a stationary position on the frame includes a rest member unitarily integral with the floor portion of the base frame and upturned from said floor in a location at the embossing end of the press and extending to a height such that the underside of said die-holder is maintained at a suitably operative level during the embossing by resting on top of the rest member.

3. An embossing press as claimed in claim 2, wherein the underside of the die-holder includes engageable restraining means and the upper end of the rest member includes engaging restraining means, each of which restraining means has such structure and is so located relative to the other of them (i) to enable them to engage one another at the start of the embossing and thereby to restrain the die-holder against forward movement during the embossing, and (ii) yet readily to disengage on withdrawal of the embossing pressure, thereby to enable forward movement of that die-holder when it is to be removed.

4. An embossing press as claimed in claim 1, wherein securing means protrude from the support back of each of the die-holders for attaching the respective die-holder to the spring fingers for it, which securing means is a mounting stud having (i) a shank extending about centrally from the support back and being integral therewith and having a diameter substantially equal to the width of the open-ended slot thereby enabling the shank to be held in the slot snugly between the opposed parallel sides of the spring fingers to avoid side-to-side movement against them, and (ii) a head with a diameter or width greater than the width of the slot so that with the height of the shank being sufficient to hold the underside of the stud's head snugly against the upper surface of the spring fingers, the die-holder is held firmly during the embossing operation.

5. An embossing press as claimed in claim 4, wherein each of the die-holders is rectangular with opposed parallel front and rear vertical walls and opposed shorter parallel sides and with its pair of opposed sides being parallel to the spring arm, and the free end of the spring arm includes die-holder restraining means to restrain the die-holder against forward movement during the embossing; and the length of the slot equals one-half of the width of the die-holder plus the radius of the shank of the mounting stud, and the inner end of the slot is arcuate with a radius substantially that of the shank thereby to enable the rearwardly facing wall of the shank to contact in registry the arcuate inner end of the slot.

6. An embossing press as claimed in claim 5, wherein the restraining means against forward movement of each of the die-holders is a restraining stub depending from the outer end of each of the spring fingers snugly to contact the forward or exposed vertical wall of the die-holder a distance sufficient to restrain the latter against forward movement during the embossing and by the springiness of the spring fingers to allow the die-holder to be removed from engagement with the spring fingers upon applying an outwardly directed force on the die-holder after the embossing force is withdrawn.

7. An embossing press as claimed in claim 6, wherein each of the spring fingers (i) at a location inward from its outer end and about equal to the width of the die-holder is bent outwardly above the upper surface of the die-holder to a location which would intersect the upper extension of the axis of the shank of the mounting stud and (ii) at said intersecting location then is bent downwardly toward the forward upper edge of the die-holder, the length of the spring fingers being such that the restraining stubs at the free ends of said fingers snugly engage the upper parts of the forward vertical wall of the die-holder, and the respective angle of each separate bend is such as to enable the die-holder to be restrained during the embossing and to be removed thereafter.

8. An embossing press for use on embossable sheet material and having an embossing or forward end, said press comprising (a) a unitary base frame having as integral holding parts thereof
  (i) a floor having integral front and rear portions, said front portion including means for supporting a die-holder thereon at said embossing end, and
  (ii) upwardly extending from said rear portion of said floor at a location rearward of said embossing end and thence forwardly to a position over said embossing end a lever supporting portion provided with means for pivotally supporting thereon the anchoring end of an operating lever; and (b) an operating lever having an anchoring end and being pivotally supported at said end by said lever-supporting portion, (c) a lower die-holder supported in stationary position on said die-holder supporting means, (d) a spring arm having a free end near said embossing end and also a fixed end remote from said free end, said spring arm
  (i) serving to support at its free end an upper die-holder above said lower die-holder and in a position to enable said upper die-holder to be moved with that free end toward and away from said lower die-holder, whereby by such movement of the upper die-holder toward said lower die-holder their respective opposed faces are brought into mating registry during embossing operation; and (ii) having anchoring means as a unitarily integral part thereof at its fixed end; and (iii) said frame floor having as a unitarily integral part thereof and extending directly upwardly therefrom a spring arm-anchoring means holding part in the shape of an upturned tongue, and the spring arm-anchoring means is yoke-shaped like an inverted U having its base at the top and having downwardly extending front and rear legs respectively depending from opposite ends of the base, both of the legs being relatively narrow parallel walls which are pushed down over the up-turned tongue and so spaced apart from one another that the yoke is fixedly held in friction-tight engagement with said tongue and yet removably anchored thereto.

9. An embossing press as claimed in claim 8, wherein the up-turned tongue in the floor has a locking opening passing through said tongue near its bottom, and the spring arm and said yoke are a one piece plastic unit wherein the leg wall further removed from the free end of the spring arm is the rear leg of the yoke, and near the bottom of the rear leg of the yoke is an integral catch positioned at a level for it to fit in registry in said locking opening, and the catch extends partially toward the other leg of the yoke and into the locking opening, and said rear leg is sufficiently flexible to enable withdrawing the catch from the opening when desired.

10. An embossing press as claimed in claim 9, wherein intermediate the forward and rear edges of the non-embossing surface of the movable die-holder is a longitudinally positioned cam surface integral with that die-holder and curving convexly outwardly from the junction of that surface and the die-holder and then forwardly at a raised level spaced away from the latter surface, and spaced rearwardly from the means for pivotally supporting it, the operating lever has a depending rib extending to each of the sides of the lever and so designed and positioned that upon depressing the lever the rib's bottom edge traverses the curved cam surface to the raised level thereof uniformly depressing the upper die-holder into embossing operation against the lower die-holder.

11. An embossing press as claimed in claim 2, wherein the upper edge of the up-turned tongue is cut out about its whole length except for a residual stub left at each end of said upper edge thereby providing an open cut therein, these stubs being spaced apart from one another a distance substantially equal to the width of the yoke, the base of the inverted U shape of the yoke being snugly seated in said open cut and said base being thus firmly held between these stubs.

12. An embossing press as claimed in claim 2, wherein the lever is spaced above the spring arm, and a second spring arm at its fixed end (i) is unitarily integral with the anchoring means adjacent the fixed end of the first spring arm and thereby constitutes a unitary spring member with the anchoring means and the first spring arm and (ii) extends below the latter to the die-holder in the stationary position on the base frame.

13. An embossing press for use on embossable sheet material and having an embossing or forward end, comprising (a) a unitary base frame having as integral parts thereof (i) a floor having integral front and rear portions, said front portion including means for supporting a first die-holder thereon at said embossing end, and (ii) upwardly extending from said floor at a position rearward of said embossing end and thence forwardly to a position over said embossing end a lever-supporting portion provided with means for pivotally supporting thereon the anchoring end of an operating lever.

(b) an operating lever pivotally supported at its said anchoring end, (c) a spring arm having a free end near said forward end and a fixed end, said spring arm (i) serving to support at its free end a second die-holder in a position to enable said second die-holder to be moved with that free end toward and away from said first die-holder, and (ii) having anchoring means at its fixed end and being flat and bifurcated at its free end, thus being provided with adjacent spaced apart spring fingers bounding an open-ended longitudinal slot for supporting said second die-holder, said second die-holder having on its upper face securing means cooperating with said slot and enabling said die-holder to be fixedly yet removably attached to said spring fingers; and (iii) further including die-holder restraining means depending from the outer end of each of the spring fingers and snugly engaging the front of the second die-holder and thereby restraining said die-holder against forward movement during embossing, yet, due to the springiness of the fingers, permitting that die-holder to be removed from engagement with the spring fingers upon applying an outwardly directed force on the die-holder.

14. An embossing press as claimed in claim 13, wherein said lever is spaced above said first recited spring arm and a second spring arm is integral with the said spring arm-anchoring means adjacent the fixed end of said first spring arm thereby constituting a unitary spring member with the anchoring means and the first spring arm, said second spring arm being spaced below said first spring arm and extending into the embossing end of said press and being provided at said end with adjacent spaced apart spring fingers bounding an open-ended longitudinal slot for maintaining said first die-holder in stationary position during the embossing operation; each of said die-holders having a mounting stud projecting from its exposed outer face for mounting the die-holder onto its respective said spring fingers and at least said mounting stud on said second die-holder has (i) a shank projecting from about the center of that exposed face and being integral therewith and having a diameter substantially equal to the width of the open-ended slot thereby enabling the shank to be held in the slot snugly between the opposed parallel sides of said spring fingers to avoid side to side movement against them, and (ii) a head having a diameter or width greater than the width of the slot thereby providing the head with an inner surface, and the height of the shank is sufficient to hold the inner surface of the stud's head snugly against the adjacent surface of the spring fingers, thereby to enable holding the die-holder firmly during the embossing operation.

15. An embossing press as claimed in claim 14, wherein each of the die-holders is rectangular with parallel front and rear vertical walls and-opposed vertical side walls, and a restraining stub extends from the free end of each spring finger of said second spring arm and normal to the finger and in contact with the forward vertical wall of the respective die-holder a sufficient distance to restrain the die-holder against forward movement during the embossing and by the springiness of the spring fingers to allow the die-holder to be removed from engagement with the spring fingers upon applying an outwardly directed force on the die-holder after the embossing force is withdrawn.

16. An embossing press as claimed in claim 15, wherein the outer face of each die-holder has intermediate its ends and medial to them a recess extending across the entire width of the die-holder, and projecting centrally from each recess is said mounting stud integral with its respective recess surface.

17. An embossing press as claimed in claim 15, wherein each of the spring fingers of said first spring arm (i) at a location inward from its outer end about equal to the width of the die-holder thereon is bent outwardly above the upper surface of the die-holder to a location which would intersect the outer extension of the axis of the shank of the mounting stud and (ii) at said intersecting location then is bent inwardly downward toward the forward adjacent edge of the die-holder, the length of the spring fingers being such that the restraining stubs at the ends of said fingers snugly engage the adjacent part of the forward vertical wall of the die-holder, and the respective angle of each separate bend is such as to enable the die-holder to be restrained during the embossing and to be removed thereafter.

18. An embossing press as claimed in claim 15, wherein the exposed face of each die-holder has intermediate its ends and medial to them a recess extending across the entire width of the die plate, centrally within which recess the mounting stud is located, the width of which recess is substantially equal to the overall width of the spring fingers and the slot between them, whereby the spring fingers are inserted in that recess straddling the shank of the mounting stud until the inner end wall of the slot contacts the peripheral surface of the stud's shank and with the exterior longitudinal edges of the spring fingers directly contacting the upright walls of the recess thereby to restrain sidewise movement of the die-holder, and with the inner vertical walls of the restraining stubs directly contacting the upper portion of the outer vertical wall of the die-holder across the width of the recess, thereby to restrain the die-holder against forward movement during the embossing.

19. An embossing press as claimed in claim 18, wherein at least the second die-holder has, intermediate the front and rear vertical walls on each of the areas extending between the recess and the outer ends of the die-holder and normal to them, an identical cam surface integral with the die-holder and curving convexely upwardly from the junction with the under surface of the die-holder and then forwardly at a level raised from that surface, and the operating lever has a depending rib so designed and positioned that upon depressing the lever the rib's bottom edge traverses the curved surfaces of both cams to their raised levels thereby uniformly depressing the second die-holder into embossing operation against the first die-holder.

20. An embossing press as claimed in claim 13, wherein the base frame has opposed parallel side walls unitarily integral with and extending upwardly from the floor, and intermediate said front and rear floor portion there extends directly upwardly from the floor a spring arm anchoring means holding part, said spring arm having anchoring means designed friction-fittingly yet removably to be anchored on said holding part, said holding part being in the form of an up-turned tongue, the lower end of which is integral with said floor.

21. An embossing press as claimed in claim 13, wherein said means for supporting said first die-holder in stationary position thereon includes a rest member integral with the floor and upturned therefrom, said rest member extending upwardly from the front floor portion to a height such that the underside of the die-holder is maintained at an operative level during the embossing by resting on top of the rest member; and wherein said rest member consists of two substantially identical and opposing parallel upright rests, each of which is cut away at its sides and upper edge and upturned from the floor, and spaced away from one another so as to maintain the die-holder level during the embossing.

22. An embossing press as claimed in claim 21, wherein the underside of the stationary die-holder has intermediate its front and rear edges a longitudinally positioned cam surface integral with the die-holder and curving convexly outwardly from the junction with the surface of the underside and then forwardly at a level spaced away from that surface.

23. An embossing press as claimed in claim 22, wherein intermediate the ends of its upper edge each upright rest has a concave cut out section peripherally conforming to the transverse peripheral outline of the cam surface.

* * * * *